US005170943A

United States Patent [19]

Artzberger

[11] Patent Number: 5,170,943

[45] Date of Patent: Dec. 15, 1992

[54] HIGH VELOCITY PNEUMATIC DEVICE

[75] Inventor: Thomas G. Artzberger, Menomonee Falls, Wis.

[73] Assignee: M-B-W Inc., Slinger, Wis.

[21] Appl. No.: 541,377

[22] Filed: Jun. 21, 1990

[51] Int. Cl.[5] ..... B05B 15/06; B05B 1/28

[52] U.S. Cl. ..... 239/532; 239/288.5; 239/290; 239/583; 239/DIG. 21

[58] Field of Search ..... 239/525, 526, 532, 583, 239/569, DIG. 21, 288, 288.5, 288.3, 290, 291, 499, DIG. 22, 280; 137/625.27 X

[56] References Cited

U.S. PATENT DOCUMENTS

| | | | |
|---|---|---|---|
| 2,539,913 | 1/1951 | Koepcke | 137/625.27 |
| 2,597,573 | 5/1952 | De Groff | 239/288 |
| 3,117,726 | 1/1964 | Schoberg | 239/291 |
| 3,599,876 | 8/1971 | Kyburg | 239/291 |
| 3,779,462 | 12/1973 | Bruninga | 239/390 |
| 3,880,355 | 4/1975 | Larson et al. | 239/291 |
| 4,243,178 | 1/1981 | Self | 239/DIG. 22 |
| 4,330,723 | 11/1981 | Prasthofer | 239/499 |
| 4,516,521 | 5/1985 | Szelagowski et al. | 239/288 |
| 4,651,929 | 3/1987 | Kranzle | 239/288 |
| 4,867,380 | 9/1989 | Sibbertsen | 239/DIG. 21 |

FOREIGN PATENT DOCUMENTS

| | | | |
|---|---|---|---|
| 244309 | 9/1960 | Australia | 137/625.27 |
| 48686 | 5/1974 | Australia | 239/DIG. 21 |

*Primary Examiner*—Andres Kashnikow
*Assistant Examiner*—Christopher G. Trainor
*Attorney, Agent, or Firm*—Andrus, Sceales, Starke & Sawall

[57] ABSTRACT

A high velocity pneumatic device having particular use for excavating or dislodging soil. The device includes a body or housing having a passage that connects a source of air under pressure, such as a compressor, to an elongated discharge tube. A valve mechanism is disposed in the passage and controls the flow of air through the tube. Mounted in the distal end of the tube is a nozzle having an inwardly converging upstream and an outwardly diverging downstream end which increases the velocity of the air being discharged through the tube. A manually operable trigger is directly connected to the valve mechanism and actuates the valve to discharge air through the tube. The nozzle is formed of a non-sparking metal, such as brass, while the tube is composed of an electrically nonconductive material, such as glass reinforced resin.

21 Claims, 2 Drawing Sheets

HIGH VELOCITY PNEUMATIC DEVICE

BACKGROUND OF THE INVENTION

High velocity pneumatic devices are used in construction work to excavate or dislodge soil from around electrical cables, water pipes, gas mains and the like. The pneumatic device has the advantage of being capable of pulverizing the soil without damaging the utility lines.

The typical high velocity pneumatic device consists of a body or housing which carries an elongated tube. The body is connected to a source of air under pressure, such as a compressor, and a valve mechanism mounted within a passage in the body controls the flow of air to the tube.

Mounted in the distal end of the tube is a nozzle which is designed to increase the velocity of the air being discharged from the tube. More specifically, the typical nozzle is provided with an inwardly converging upstream end which merges into a diverging downstream end. This configuration acts to reduce the pressure of the air or gas and increases the velocity, so that in practice the air being discharged from the tube can have a velocity up to about 2200 feet per second.

European patent application 0 251 660 describes a typical high velocity pneumatic device having particular use for excavating soil. The device as described in the aforementioned patent application includes a complicated valve mechanism, including both a pilot valve and a main control valve. Manual operation of the trigger by the operator will open the pilot valve which generates a signal that is transmitted to the main valve to open the main valve and supply compressed air through the discharge tube. It has been found that dirt and foreign material can readily clog the openings in the pilot valve, requiring frequent disassembly and cleaning of the valve. When disassembled for cleaning, the pilot valve is difficult to realign on assembly, thus requiring substantial down-time for the cleaning operation.

Pneumatic devices as used in the past have also included a discharge tube composed of two or more connected sections. The connections between the sections results in an inwardly protruding joint which produces turbulence in the air flow, thus reducing the discharge velocity.

As a further problem, the high velocity pneumatic devices as used in the past have generally included a steel discharge tube with a brass nozzle being mounted in the distal end of the tube. While the brass nozzle is non-sparking, the steel tube is electrically conductive which can pose a hazard to the operator in the event the device is employed to excavate soil around a ruptured electrical cable.

Therefore, there has been a need for a simple and inexpensive high velocity pneumatic device which eliminates the possibility of explosions or the transmission of electrical current during use.

SUMMARY OF THE INVENTION

The invention is directed to an improved high velocity pneumatic device, having particular use for excavating or pulverizing soil around utility lines, trees, shrubs or the like. The device includes a body having a passage which interconnects a source of air under pressure, such as an air compressor, and an elongated discharge tube that is removably connected to the body.

A valve is mounted in the passage and the valve is moved between an open and closed position by a trigger mechanism which is pivotally connected to the body.

One end of the trigger defines a hand grip to be grasped by the operator, while the other end of the trigger is directly connected to a pin which actuates the valve. By squeezing the trigger, the valve will be actuated to supply air under pressure to the dischrge tube.

Mounted in the distal end of the tubular member is a nozzle, formed of a non-sparking material, such as brass. The nozzle is configured to increase the velocity of the air being discharged. In this regard, the upstream end of the nozzle converges inwardly while the downstream end diverges outwardly. With this configuration the pressure of the air flowing through the nozzle is decreased, while the velocity is substantially increased.

In accordance with the invention, the tubular member is formed of an electrically nonconductive or dielectric material, preferably a thermosetting resin containing fibrous reinforcement, such as fiber glass. The non-sparking nozzle and the dielectric tubular member eliminate the possibility of the ignition of gas fumes, or the conduction of electrical voltage in the event the tube should strike an electric cable, thus providing a safe and reliable mechanism.

As a further aspect of the invention, an accessory can be included with the discharge tube which acts to provide an annular, downwardly-directed air curtain on the outer surface of the tube. The air curtain will deflect any soil particles being directed upwardly by virtue of the main gas stream that passes through the nozzle and engages the soil. The air curtain is preferably provided by mounting a sleeve in spaced relation around the tube, with the ends of the sleeve being sealed to the tube. A plurality of ports provide communication between the interior of the tube and the annular chamber defined by the tube and the sleeve, so that air will pass into the annular chamber. The lower end of the sleeve diverges outwardly and is provided with a plurality of slots which extend at an acute angle to the axis of the tube. Thus the air passing into the annular chamber will be directed downwardly in a diverging pattern around the tube to provide an air curtain that will deflect any soil particles that are directed upwardly by the main gas stream.

The invention provides a simple, high velocity soil excavating device which is simple to manufacture and service. As the device includes no small exposed valve passages which can clog with foreign material, it can be used for extended periods without service or maintenance.

As the discharge tube is a one-piece construction, preferably formed of fiber reinforced resin, it has a smooth inner surface without internally projecting joints, thus providing better laminar air flow than constructions utilizing a sectionalized tube.

With the construction of the invention the trigger is mounted within an opening in the handle or body so that it is enclosed. Thus, if the device is dropped, the trigger cannot be actuated, thus providing an added safety feature.

As a further advantage, the trigger is located in direct alignment with the tube. If the tube tends to kick rearwardly as air is discharged from the tube against the soil, the force is directed against the hand grip, thus minimizing any tendency for the tube to pivot due to this reactive force.

The device of the invention is generally used in short bursts. The air delivered by the air compressor is heated, generally having a temperature of over 100° over ambient. With extended use the tube can become heated and with a metal tube, the temperature of the tube can be elevated to a point where it cannot be handled by an operator without the use of some insulating material. However, with the use of a dielectric tube, as in the invention, the temperature is maintained at a level that does not require insulation for the tube.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
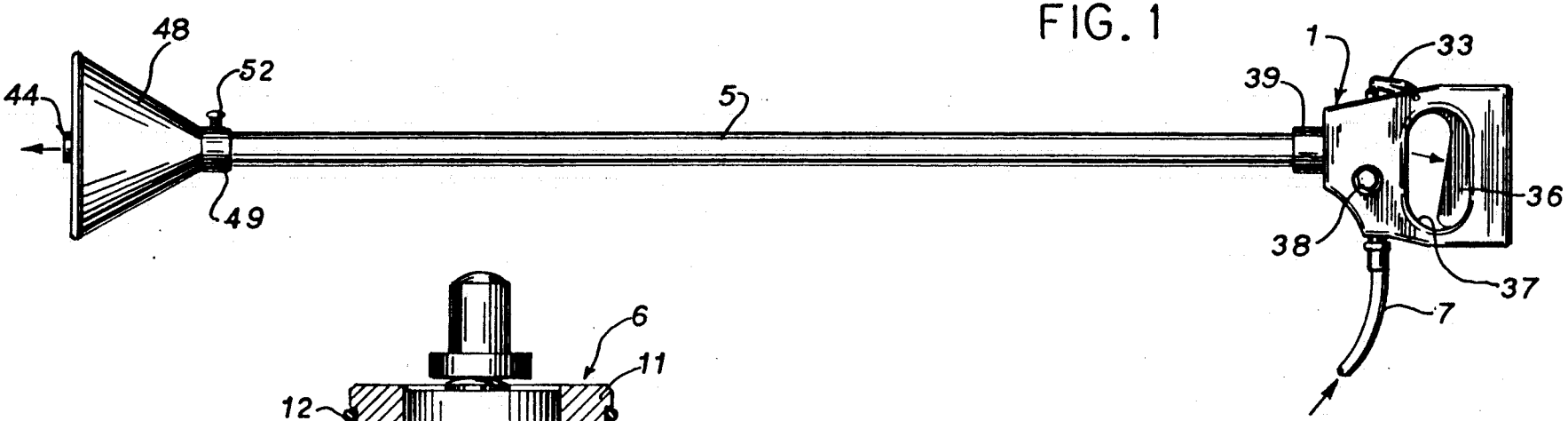
FIG. 1 is a side elevation of the device of the invention.
Figure 4:
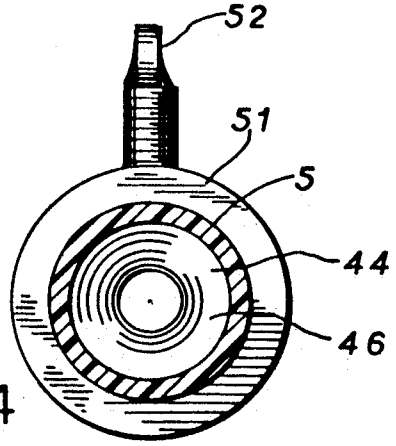
FIG. 4 is a section taken along line 4—4 of FIG. 2.

The drawings illustrate a high velocity pneumatic device which has particular use in excavating or dislodging soil around utility lines, trees or shrubs, or the like. The device includes a body or housing 1 having a passage 2 that extends through the body. An opening 4 communicates with the central portion of the passage and an elongated discharge tube 5 is mounted in the opening 4.

A gas, such as compressed air, is supplied to one end of passage 2 through a supply conduit 7, which is connected to an air compressor or other source of air under pressure. A valve assembly 6 is mounted within passage 2 and controls the flow of air through opening 4 to discharge tube 5.

Figure 3:
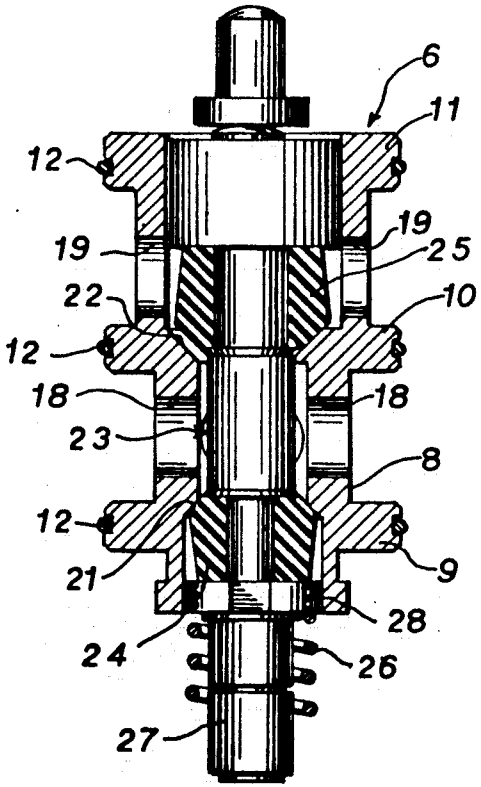
FIG. 3 is a longitudinal section of the valve mechanism.

As best shown in FIG. 3, the valve assembly 6 comprises an outer spool 8 having a series of spaced annular flanges 91, 10 and 11. Each of the flanges is provided with a peripheral groove which receives an O-ring seal 12 that seals the flange against the enlarged end 13 of passage 2.

Figure 2:
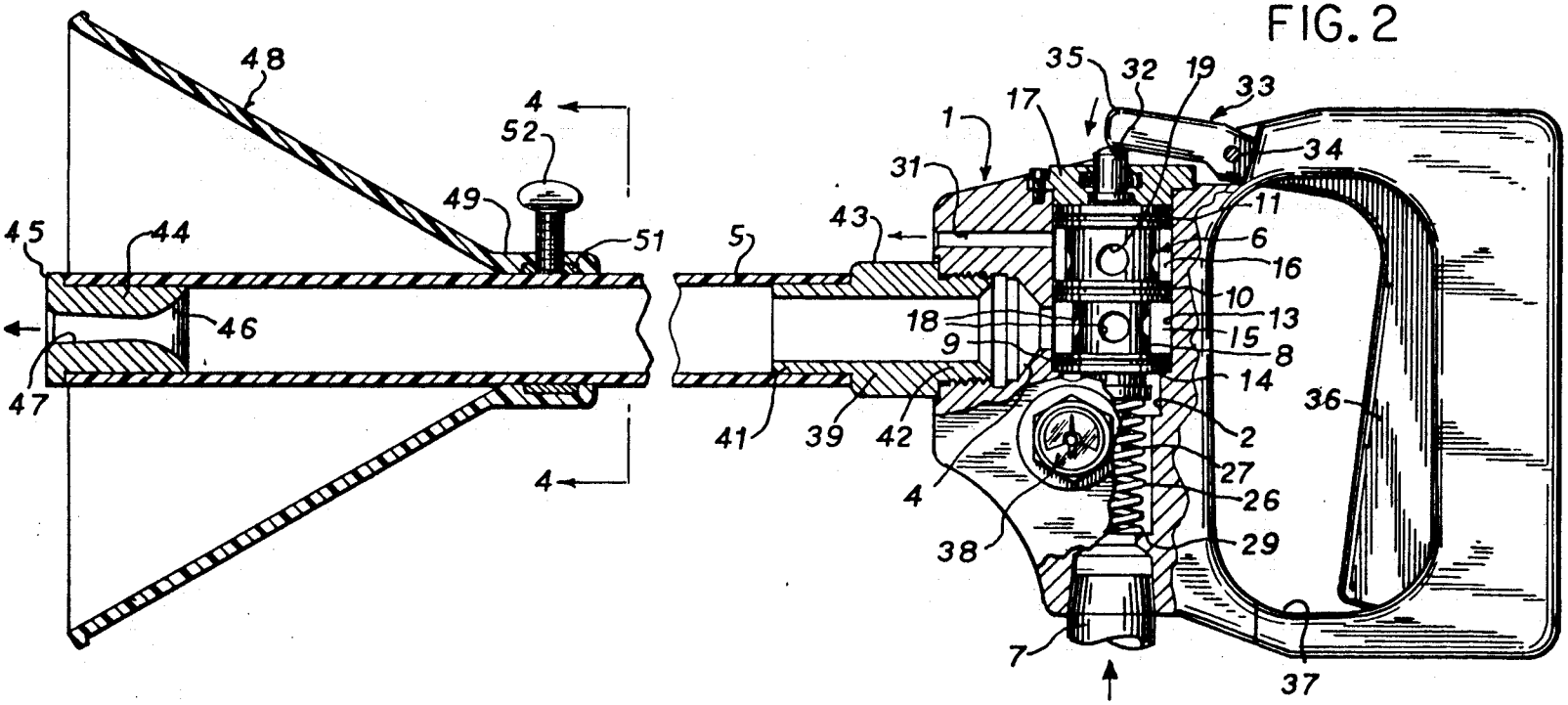
FIG. 2 is an enlarged, side elevation with parts broken away in sections.

As illustrated in FIG. 2, the flange 9 bears against an internal shoulder 114 in passage 2. The space between the flanges 9 and 110 defines an annular chamber 15, while the space between the flanges 10 and 11 defines a second annular chamber 16.

To retain spool 8 within passage 2, a cap 17 is threaded within the end of the passage and bears against the flange 11 of the spool.

A plurality of ports 18 are formed in the spool between flanges 9 and 10 and communicate with chamber 15, and similarly, a second group of ports 19 are formed between flanges 10 and 11 and establish communication with the chamber 16.

Located on the inner surface of spool 8 are valve seats 21 and 22. Valve seat 21 is located upstream of the ports 1181, while valve seat 22 is located between the ports 18 and 19.

Mounted for a sliding movement within a spool 8 is a plunger 23. The plunger is provided with a pair of annular valves 24 and 25. Valve 24 is adapted to engage valve seat 21, while valve 25 is positioned to engage the valve seat 22. As shown in FIG. 2, when valve 24 is closed, valve 25 will be open, and conversely, when valve 25 is closed, valve 24 will be open.

Valve 24 is biased to a closed position by a coil spring 26 which is positioned around the stem 27 of plunger 23. One end of spring 26 bears against a collar 28 formed on the plunger, while the opposite end of the spring engages an internal ledge 29 in passage 2. Thus, the force of the spring will urge the valve 24 to the closed position, and similarly, will urge valve 25 to the open position.

Body 1 is also formed with a vent passage 31 which communicates with chamber 16.

To move the plunger 23 relative to spool 8, a pin 32 projects through the outer end of the spool and engages the end of plunger 23. The opposite end of the pin is engaged with a trigger 33 which is mounted for pivoting movement on body 11 about a pivot 34. One end 35 of the trigger is engaged with the outer end of pin 32, while the opposite end of the trigger defines a hand grip 36, which is located within a central opening 37 in body 1. By squeezing the hand grip 36, trigger 33 will be pivoted to move end 35 against plunger 23 and correspondingly move plunger 23 inwardly to open valve 24 and correspondingly close valve 25. Opening valve 24 will permit air from the supply conduit 7 to pass through ports 18 into chamber 15 and then through opening 4 to discharge tube 5.

On actuation of the trigger, there will be an instant when both valves 24 and 25 will be open. Thus, during this instant, the air under pressure will flow through the open valve 24 and through the ports 19 and vent passage 31 to the exterior.

A conventional pressure gauge 38 can be mounted on body 1 and can indicate the pressure in the supply conduit, or alternately can indicate whether the pressure is at an operable or non-operable level.

Tube 5 generally has a length in the range of about 4 feet and has a uniform internal diameter. The tube is formed of an electrically nonconductive or dielectric material, preferably a thermosetting resin reinforced by fibrous material, such as polyester resin reinforced with glass fibers.

The inner end of tube 5 is connected to body 1 via a connector 39. One end 41 of the connector is secured within the end of tube 5 through a suitable adhesive, while the opposite end 42 is threaded within opening 4. Connector 39 is also provided with an enlarged knurled portion 43 through which the tube can be readily threaded to body 1.

Mounted in the distal or outer end of tube 5 is a nozzle 44. The nozzle is formed of a non-sparking metal, such as brass, and is preferably secured within the tube through use of a suitable adhesive. The outer end of nozzle 44 is formed with an outwardly extending flange 45, which bears against the outer end of tube 5, as shown in FIG. 2.

Nozzle 44 is designed in a conventional manner to provide an increase in velocity of the air being discharged from the tube. In this regard, the upstream end 46 of the nozzle converges inwardly, while the downstream end 47 diverges outwardly. With this construction the pressure of the air is reduced as it passes through the nozzle, while the velocity is substantially increased. In practice, the velocity of the air being discharged from the tube may be in the neighborhood of 1400 miles per hour or 2050 feet per second. This high velocity acts to effectively pulverize the soil and dislodge the soil from obstructions, such as utility lines, plant roots and the like.

To prevent soil particles from being blown upwardly toward the operator, a generally conical deflector 48 can be mounted on the lower end of tube 5. Deflector 48 is provided with an annular collar 49, and the collar houses a metal ring 51. A thumbscrew 52 extends through the collar and is engaged with the ring 51 to secure the deflector in position. By loosening thumbscrew 52, the deflector can slide longitudinally of the tube to change its position as desired.

With the use of the deflector 48, soil particles being driven upwardly by the air will be captured and deflected by the deflector.

Figure 5:
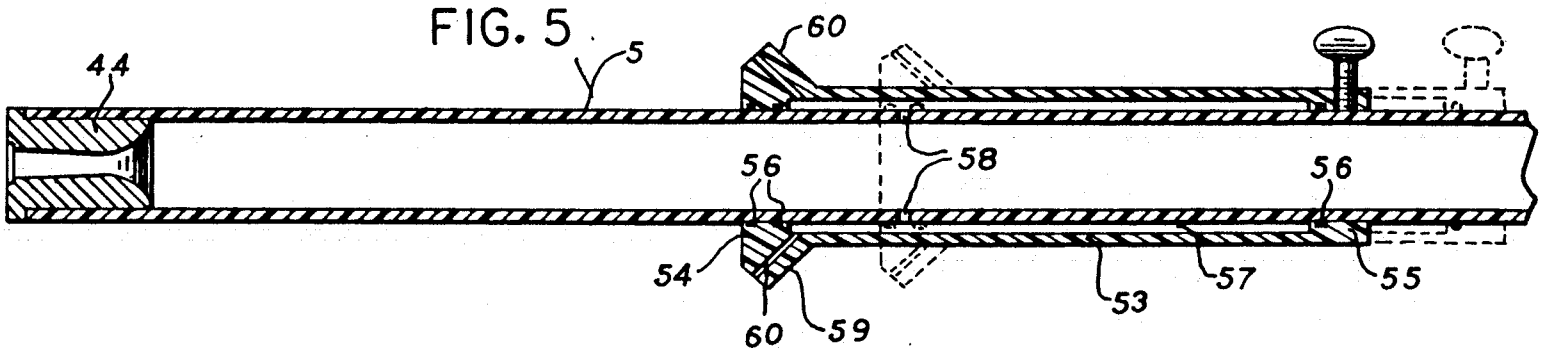
FIG. 5 is a fragmentary longitudinal section showing a modified form of the invention which produces an annular air curtain around the tube.

FIG. 5 shows a modified form of the invention which includes a mechanism for creating a downwardly directed annular air curtain around the tube to prevent soil particles from being driven upwardly toward the operator. As illustrated in FIG. 5, this mechanism includes a sleeve 53 which is positioned around tube 5, and the enlarged ends 54 and 55 of the sleeve are sealed to the outer surface of the tube through a plurality of O-ring seals 56.

The space between sleeve 53 and tube 55 defines an annular chamber 57. A plurality of openings or ports 58 in the tube provide communication between the interior of the tube and chamber 57.

As illustrated in the drawings, the lower end of sleeve 53 is enlarged and diverges outwardly, as indicated by 59 and a plurality of circumferentially spaced slots 60 are provided in end 59. Slots 60 extend at an acute angle to the axis of tube 5 and are preferably located at an angle of 30° to 60° and preferably about 45°, with respect to the axis. A thumb screw 61 can be used to lock sleeve 53 against movement relative to tube 5.

With the construction of FIG. 5, air within the tube 5 will pass through the ports 58 into chamber 57 and will then be discharged through slots 60 in the form of an annular air curtain. The air curtain will contact and deflect any soil particles that are being thrown upwardly, thus preventing the soil particles from contacting the operator. With the air curtain the discharge end of the tube 5 is visible to the operator, so that the air stream can be more effectively directed to the desired location.

If the air curtain is not desired, the sleeve 53 can be moved upwardly on tube 5 to a position where ports 58 are closed off by enlarged end 59, as shown by the dashed lines in FIG. 5.

The device of the invention has particular use for excavating or dislodging soil around utility lines, such as electrical conduits, gas mains, water lines and the like. However, the device can be used for other purposes, such as cleaning vehicles, barns, roadways and the like. It also has use in dislodging soil in the transplanting of trees and shrubs, for the high velocity air stream will not damage the root system of the plants.

As the nozzle is non-sparking and the tube 5 is formed of a dielectric material, the device has improved safety characteristics over pneumatic soil excavators as used in the past.

The insulating tube 5 has a further advantage in that the temperature of the tube will be maintained at a comfortable value during usage and will not provide a hazard to the operator's hands.

As the trigger 33 is located directly behind the discharge tube 5, any kickback or reactive force exerted through the tube will be exerted directly against the position of the operator's hand, thus minimizing the tendency of the device to tilt due to kickback. Tilting of the tube through kickback could direct the airstream to undesired locations and thus this tendency is minimized.

Various modes of carrying out the invention are contemplated as being within the scope of the following claims particularly pointing out and distinctly claiming the subject matter which is regarded as the invention.

We claim:

1. A high velocity pneumatic excavating apparatus, comprising a body having passage means extending therethrough, gas supply means connected to said passage means for supplying a gas under pressure to said passage means, an elongated tube having one end connected to said passage means and having a distal end, valve means disposed in said passage means for opening and closing said passage means, a separate nozzle mounted on the distal end of said tube and constructed and arranged to increase the velocity of the gas being discharged through said nozzle, manual actuating means operably connected to said valve means for moving said valve means to an open position to enable gas to pass through said passage means to said tube, said nozzle being composed of a nonsparking metal and said tube being electrically non-conductive and composed of fiber reinforced thermosetting resin.

2. The apparatus of claim 1, wherein said non-sparking metal is brass.

3. The apparatus of claim 1, wherein said actuating means comprises a trigger pivoted to said body, one end of said trigger defining a hand grip to be engaged by an operator and a second end of said trigger being operably connected to said valve means.

4. The apparatus of claim 3, wherein the hand grip is aligned with said tube.

5. The apparatus of claim 1, and including deflector means mounted on the tube and having a generally conical distal end disposed radially outward of the distal end of said tube.

6. The apparatus of claim 5, wherein said deflector means has a small diameter end secured to the outer surface of said tube and a larger diameter distal end.

7. The apparatus of claim 6, and including adjusting means for adjusting the position of said deflector means on said tube.

8. The apparatus of claim 1, wherein said nozzle defines an orifice with the upstream end of said orifice converging inwardly and the downstream end of said orifice diverging outwardly.

9. The apparatus of claim 1 and including pressure indicating means disposed on said body for indicating the pressure of said gas.

10. The apparatus of claim 1, wherein said nozzle is annular in shape and an end of said nozzle has an outwardly extending radial flange, the distal end of said tube being engaged with said flange.

11. A high velocity pneumatic excavating apparatus, comprising a body having passage means extending therethrough, gas supply means connected to said passage means for supplying a gas under pressure to said passage means, a tube having one end connected to said passage means and having a distal end, valve means disposed in said passage means for opening and closing said passage means, a nozzle mounted in the distal end of said tube and constructed and arranged to increase the velocity of the gas being discharged through said nozzle and against a material to be excavated, manual actuating means operably connected to said valve means for moving said valve means to an open position to enable gas to pass through said passage means to said tube, a sleeve spaced outwardly of said tube to provide an annular chamber therebetween, port means in said tube providing communication between the interior of said tube and said chamber, and discharge means communicating with said chamber for discharging gas from the chamber and around the tube in the form of an annular curtain, wherein said sleeve has an operative position where said port means communicates with said chamber and an inoperative position where a portion of said sleeve closes off said port means so that said port means is out of communication with said chamber.

12. The apparatus of claim 11, wherein said portion comprises an annular section on the inner surface of said sleeve.

13. The apparatus of claim 11, wherein said discharge means comprises a plurality of circularly-spaced ports.

14. The apparatus of claim 13, wherein said ports are disposed at an acute angle to the axis of said tube.

15. The apparatus of claim 11, and including sealing means for sealing the ends of said sleeve to said tube.

16. The apparatus of claim 11, wherein said sleeve is slidable longitudinally on said tube.

17. The apparatus of claim 16, and including locking means for locking the sleeve in position relative to said tube.

18. The apparatus of claim 14, wherein said ports are disposed at an angle of 30° to 60° degrees with respect to the axis of said tube.

19. A high velocity pneumatic apparatus, comprising a body having passage means extending therethrough, gas supply means connected to said passage means for supplying gas under pressure to said passage means, a tube having one end connected to said passage means and having a distal end, valve means disposed in said passage means for opening and closing said passage means, a nozzle mounted in the distal end of said tube and constructed and arranged to increase the velocity of the gas being discharged through said nozzle, actuating means operably connected to said valve means for moving said valve means to an open position to enable gas to pass through said passage means to said tube, said nozzle having an upstream end and a downstream end and having an orifice extending between said ends, said orifice including an upstream inwardly converging section and a downstream outwardly diverging section terminating in an outlet, said downstream end being disposed normal to the axis of said orifice, end having a recess coaxial with said orifice, and said recess having a greater diameter than said outlet.

20. The apparatus of claim 19, wherein said recess includes a bottom wall disposed parallel to said downstream end and an annular side wall connecting said bottom wall to said downstream end.

21. The apparatus of claim 20, wherein said side wall is disposed at an angle to the axis of said orifice and diverges outwardly from said bottom wall.

* * * * *